United States Patent [19]

Bohland et al.

[11] Patent Number: 4,608,932

[45] Date of Patent: Sep. 2, 1986

[54] SAFETY DEPOSIT BOX SYSTEM

[75] Inventors: Robert J. Bohland; Charles E. Delamater; John W. Elseser; William L. Gensamer, all of Stark County, Ohio

[73] Assignee: Diebold, Incorporated, Canton, Ohio

[21] Appl. No.: 614,185

[22] Filed: May 25, 1984

[51] Int. Cl.[4] ..... E05G 1/00

[52] U.S. Cl. ..... 109/56; 109/53; 109/74; 312/199

[58] Field of Search ..... 109/49.5, 53, 56, 64, 109/67, 74, 76, 77, 85; 52/785, 793; 312/111, 199, 292

[56] References Cited

U.S. PATENT DOCUMENTS

| | | | |
|---|---|---|---|
| 287,955 | 11/1883 | Mosler | 109/64 |
| 3,837,299 | 9/1974 | McClellan | 109/53 |
| 3,871,283 | 3/1975 | John | 109/56 |
| 3,918,371 | 11/1975 | Gartner et al. | 109/56 |
| 4,073,554 | 2/1978 | Oder et al. | 109/53 |

FOREIGN PATENT DOCUMENTS

| | | | |
|---|---|---|---|
| 1917103 | 9/1970 | Fed. Rep. of Germany | 109/76 |

*Primary Examiner*—Gary L. Smith
*Assistant Examiner*—Neill Wilson
*Attorney, Agent, or Firm*—Ralph E. Jocke

[57] ABSTRACT

An improved safety deposit box system includes a casing having parallel vertical side walls and parallel horizontal top and bottom walls. A plurality of vertical casing partitions and horizontal casing shelves within the side, top and bottom walls define a plurality of compartments. A die cast frame is mounted to the front of the casing. The frame includes horizontal frame shelves forwardly disposed of the respective casing shelves; top and bottom walls; and vertical walls forwardly disposed of the vertical casing walls and partitions. The vertical walls of the frame are positioned so that one of said vertical partitions or side walls of the casing adjacent to each compartment is accessible. The vertical frame walls also include latch receptacles. The latch receptacles are positioned in each compartment opposite from the accessible casing wall. The accessible vertical casing partition or side wall in each compartment is fixably attached to a first leaf of a hinge. The hinge has a second leaf fixably attached to a door movable to open and close the compartment adjacent the hinge. The door incorporates a lock for locking it in a closed position. The lock latches in the receptacle incorporated into the vertical frame wall of the compartment to secure the door in the closed position.

15 Claims, 9 Drawing Figures

SAFETY DEPOSIT BOX SYSTEM

BACKGROUND OF THE INVENTION

This invention relates to safety deposit boxes, and to doors for safety deposit boxes.

Safety deposit boxes have long been standard storage devices in banks, wherein bank patrons can store valuable papers, jewelry, heirlooms and the like. Such boxes conventionally include columns and rows of compartments, access to which is controlled by doors having locking devices to assure access only to duly authorized persons. Although in the past safety deposit boxes and the doors therefore were constructed of polished, hardened or stainless steel plate because of the great strength of such metal plate, the cost of the metal plate, the cost of constructing the boxes and doors from the plate, the difficulties in transporting the heavy components of plate boxes and doors, and the costly polishing and maintenance of steel plate, have led to the search for less costly safety deposit boxes and doors. The search has been aimed at safety deposit boxes and doors which are easier and faster to construct and maintain, use inexpensive materials, and require a lower degree of construction skill—while not compromising the security of the box and door.

Thus, a modular safety deposit box is disclosed in U.S. Pat. No. 4,073,554. This patent describes a safety deposit box system having a casing and a door frame attachable to the forward end of the casing. One size casing can be used for various sizes of boxes, and an optional vertical divider defines the size of the boxes in the casing. When the casing is to house a pair of columns of boxes, the vertical divider is included in the casing and a vertical center post is attached in the door frame. This vertical divider has a rearwardly facing vertical groove for receiving the forward edge of the vertical divider. The door frame is riveted to the casing and the centerpost is riveted to the vertical divider. A central hinge post is riveted to the center post for receiving the doors which open in a butterfly fashion. One of the objectives of the foregoing construction was to provide a safety box system having a door frame which could be pre-assembled with a number of access parts corresponding to the number of boxes in the casing for subsequent attachment to the casing at the installation site.

Although the foregoing modular safety box system may have provided certain features enabling the partial pre-assembly of the unit for subsequent final assembly at the installation site, there are certain characteristics of that system which render it vulnerable to improper access. Moreover, it does require certain parts which could be advantageously eliminated for reasons of economy and security. Additionally, it requires welding in some places which add labor costs to its fabrication, detract from the effectiveness and appearance of the system, and identify it as a system made of components other than steel plate which could tempt a thief to try to compromise the system. More specifically, the door frame of the system is riveted to the casing and the center post is riveted to the vertical divider. If the rivets connecting the centerpost to the divider are omitted, the rest of the system can nonetheless be assembled without the omission of the rivets being readily apparent. In this event, a thief would be able to remove the rivets securing the frame to the casing and then remove the frame with all of the doors to the respective boxes in the casing. Moreover, the door frame assembly could then be replaced on the casing to hide the break in. The foregoing system further requires the centerpost in the door frame as a support member for the hinge post for the butterfly doors. The elimination of this part, and of the labor costs associated with assembling it in the door frame, would be economically advantageous. Additionally, the doors of the preceding system are mounted on the hinge post with pop rivets. It is possible for a person to rightfully (or improperly) open one door, remove the pop rivets and thus gain access to the adjacent box. Thus, it would be very desirable to provide an improved modular safety deposit box system which avoids the foregoing shortcomings of previous attempts to develop such constructions.

Doors for safety deposit boxes are well known in the art, but for various reasons relating to their cost, effectiveness and complexity, they suffer from a variety of shortcomings. For many years, conventional safety deposit box doors were constructed from solid carbon steel or other plate to provide abundant security against unauthorized access through the door to the box. Although fulfilling this goal, such doors were expensive because of material costs and because of the long fabrication time and attendant labor costs. Moreover, carbon steel doors require frequent hand polishing for aesthetic purposes. Stainless steel doors do not require polishing, but their construction costs are very high.

Efforts have been made to develop less costly safety deposit box doors than the foregoing steel doors. If such replacements are developed which are more vulnerable than steel doors, it is generally desirable that the replacements have the appearance of the rugged steel doors. Single piece die cast doors are known in the art. These generally consist of flat plates with inward facing flanges. Although relatively inexpensive, such door construction are not entirely satisfactory. The forward face of the door must be polished or painted to give it the desired appearance. Moreover, the true construction of the door becomes apparent when it is opened and its thin wall can be seen. Therefore, proposals have been made for attaching a flat sheet on the inside of die cast and other non-plate safety deposit doors to give the doors the appearance of a steel plate construction. For example, U.S. Pat. No. 3,837,299 discloses a safe deposit box assembly having a hollow door made of two metal sheets having marginal flanges, the sheets being welded together at the flanges to form a hollow door and then subsequently ground down. The welding and grinding steps are relatively expensive. U.S. Pat. Nos. 3,871,283 and 3,918,371 describe clam shell or butterfly type safe deposit box door constructions where a central hinge for a pair of doors can be mounted on a vertical wall member without the use of fasteners. A drawback of the construction of the '283 device is that commonly hinged pairs of doors can be removed from the vertical wall member when both doors are open. The other patent eliminates this problem by preventing one door from opening if its companion door is already open, this also being an inconvenience. The doors themselves include front and rear cast plates which are screwed together by means of aligned tapped sockets. These apparatuses are also relatively costly to construct. They do not have the appearance of steel doors.

SUMMARY OF THE INVENTION

It is an object of the present invention to provide an improved safety deposit door system which is economical to construct while providing security against unauthorized access.

Another object of the invention is the provision of a safety deposit door system made of relatively inexpensive material which can be assembled efficiently and economically.

Still another object of the invention is to provide an improved safety deposit box system having a front door frame assembly which can be pre-assembled and securely attached to a casing without resort to means whose omission could pass undetected.

Another object of the invention is to provide an improved safety deposit box system fulfilling other objects set forth herein which can be constructed as a modular unit for assembly with similar modular units.

An additional object is to provide a system as described above having the appearance of a steel plate construction.

Another object is to provide a door frame for a safety deposit box system which can be attached to a casing in an easy yet precise manner without jeopardizing the security of the system.

It is a further object to provide a door frame which can be produced economically as an integral unit.

The provision of such a door which can be constructed in a fast and economical manner while being secure against unauthorized access is still another object of the invention.

Another object is the provision of the foregoing type of door which has the appearance of a solid metal plate door.

Other objects will become apparent from the description to follow and from the appended claims.

Accordingly, a safety deposit box system according to the invention in its preferred form includes a casing divided by vertical walls and horizontal shelves into a plurality of compartments or boxes and a door frame assembly for direct attachment to the casing. The door frame assembly includes abutment surfaces for engaging the rearward faces of the doors to prevent the doors from being rammed into the compartments. The door assemblies are attached directly to vertical walls of the casing. The door assemblies are of a butterfly construction, with pairs of doors being commonly hinged. The frame and doors are preferably zinc die castings which are constructed to give them the appearance of stainless or polished steel plate products. The forward portion of the doors is covered by a metal sheet glued to interior ribs of the door to give the door the stainless or polished steel plate appearance. The edges and rear face of the door are cast as solid walls, so that even in the open position the door appears to be made of plate.

DESCRIPTION OF THE PREFERRED EMBODIMENT

Figure 1:
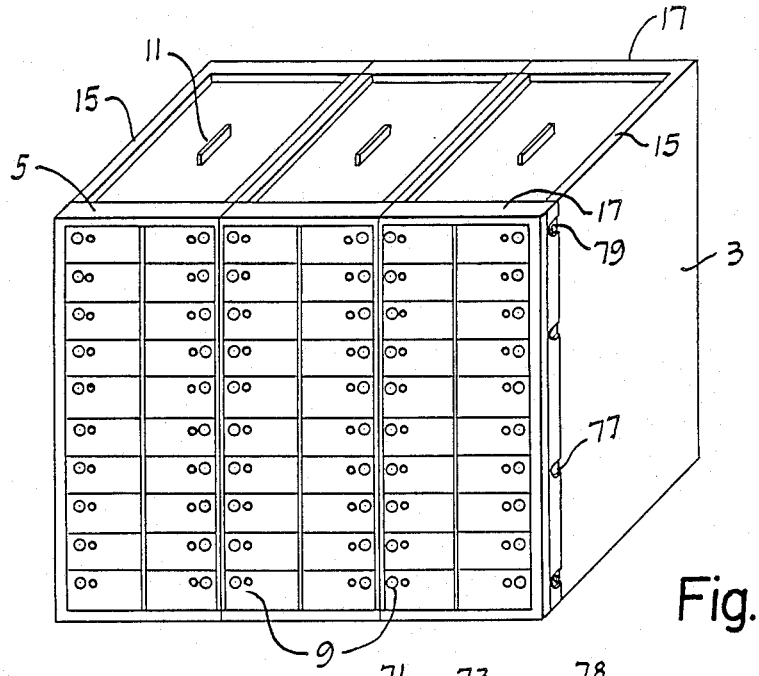
FIG. 1 is a perspective view of a safety deposit box system according to the preferred embodiment of the invention.

Referring first to FIG. 1, a safety deposit box system 1 is shown comprising three casings or cabinet assemblies 3, three door frames 5 and a plurality of double door assemblies 9, giving access to six columns of compartments or boxes which can be secured by the respective doors. System 1 is composed of modular units which are adapted to be stacked with or assembled adjacent similar units. Sets of forwardly extending side ribs 15, horizontal ribs 17 and frames 5 add to the strength and rigidity of system 1 for supporting other stacked units.

Figure 2:
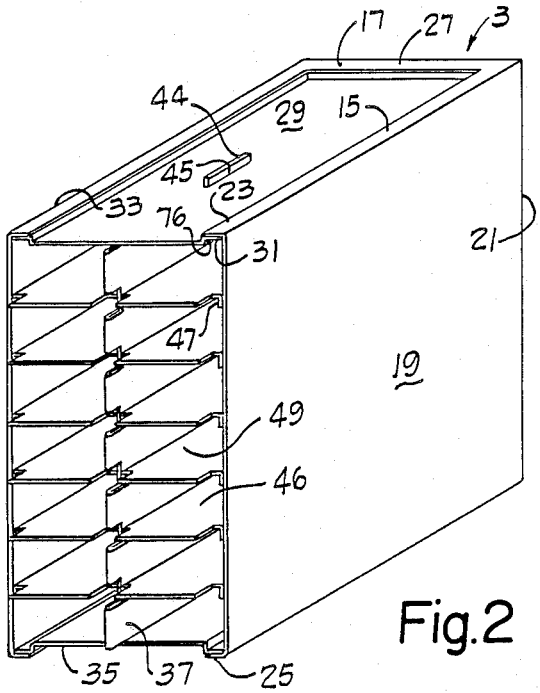
FIG. 2 is a perspective view of one of the cabinets or casings of the system shown in FIG. 1.

Turning next to FIG. 2, cabinet assembly 3 is shown in further detail. The respective components are preferably formed metal parts of sheet steel stock. The cabinet includes opposing parallel side walls 19, connected by a back wall 21 which can be integral with one or both of the side walls. The side walls terminate in upper and lower inwardly bent tabs 23, 25, respectively. Similarly, back wall 21 terminates in an upper, inwardly bent tab 27 and a lower, inwardly bent tab. A top panel 29 forms the top of the cabinet. It includes a pair of edge ribs 31 adjacent the sides of the cabinet. Tabs 23 and ribs 31 cooperate to form ribs 15. A bottom panel 35 is similar to top panel 29. Ribs corresponding to ribs 31 are formed in panel 35. A vertical panel 37 extends between top panel 29 and bottom panel 35. Vertical panel 37 serves as a support for the hinges of door assemblies 9 as discussed below, and they should be positioned precisely. Panel 37 includes vertical tabs 44 which protrude through openings 45 in walls 29 and 35, respectively. These tabs and openings are precision cut with dies, and serve to locate panel 37 during the construction of cabinet 3. In addition, a set of hozizontal shelves 46 extend from the front of the cabinet to rear wall 21. The shelves have downturned tabs 47 to which are spot welded the respective side walls 19 and partition 37. Shelves 46 cooperate with side walls 19 and partition 37 to define a plurality of the safe deposit boxes or compartments 49. The various ribs and tabs are preferably attached to the other members of the cabinet by conventional welding techniques.

Figure 3:
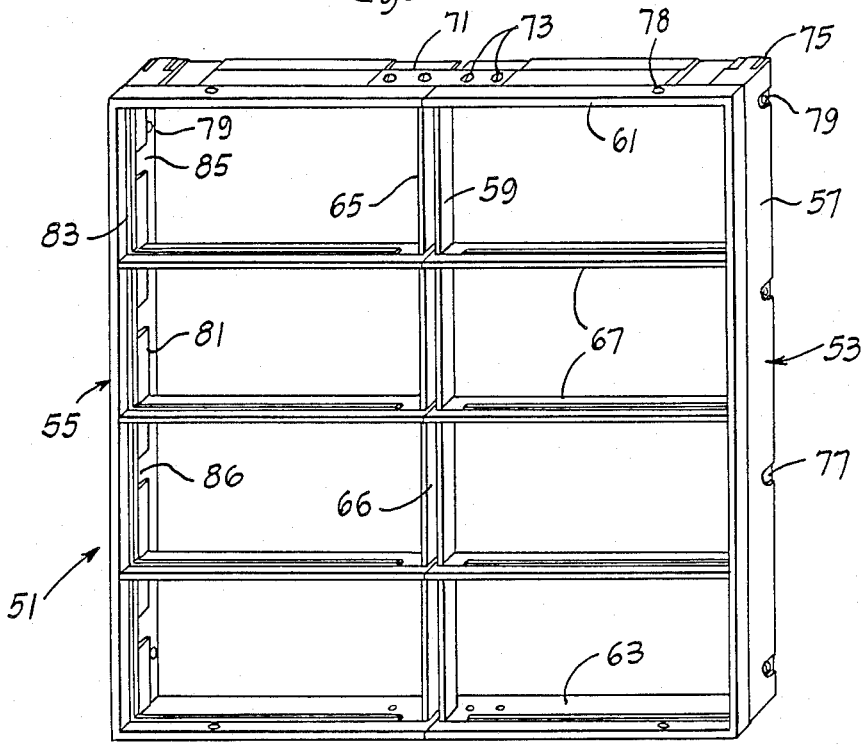
FIG. 3 is a perspective front view of the door frame of the system in FIG. 1.
Figure 4:
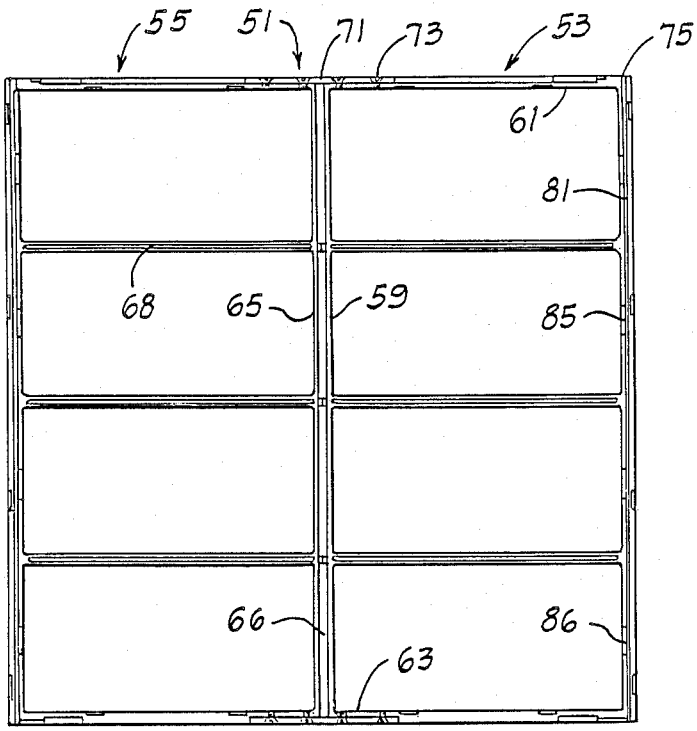
FIG. 4 is a rear view of the door frame in FIG. 3.

A frame assembly 51 as shown in FIGS. 3 and 4 is attached directly to cabinet 3. The frame assembly includes a plurality of frame members whose number depends upon the number of safety box compartments with which the assembly is to cooperate. Individual frame members can be used alone. For the purposes of illustration, two frame members 53, 55 are shown as forming assembly 51. The frame members are identical. Frame member 53 includes opposing side walls 57, 59 connected at their opposite ends to top and bottom frame walls 61, 63. The foregoing walls are spaced to align with vertical side walls and/or partitions of cabinet 3 as described below. A side wall 65 of frame member 55 is spaced from the corresponding wall 59 of frame member 53 to define a slot 66 for receiving the forward portion of cabinet partition 37 as described below. A set of horizontal shelves 67, spaced and dimensioned to align with shelves 45 in cabinet 3 extend between respective central vertical frame walls 57, 59. As shown in FIG. 4, the rear edges of shelves 67 have slots 68 for receiving the forward edges of shelves 46. Top wall 61 and bottom wall 63 are of like construction, and only the details of wall 61 will be described. A connecting plate 71 attaches frame members 53, 55 together as does a like plate at the bottom of the assembly. The plate is secured to frame members 53, 55 by self-tapping screws 73. Holes which accept screws 73 are preferably cast into the frame. Wall 61 further includes a vertical slot 75 dimensioned to receive the inside face 76 or rib 23. A hole 78 extends through wall 61 for receiving a fastener such as a rivet for attaching frame assembly 53 to cabinet 3.

Sidewalls 53 and 55 are also identical. The exterior side of each sidewall 53, 55 has a set of notches 77 and holes 79 in notches 77 through which fasteners such as rivets can be inserted when attaching the assembly to cabinet 3. Notches 77 are of a depth to countersink the heads of rivets inserted in holes 79 below the outermost part of wall 57, so that frames 51 can be assembled side by side without their proximity being limited by the rivet heads. The inner side of each sidewall has a raised ridge 81 which terminates in a forwardly facing shoulder 83 against which the respective safety box door assemblies abut as described below. A notch 85 is provided in ridge 81 in each compartment for receiving a latch of the lock assembly of the respective door assemblies. Notches 85 extend from the rearward direction and terminate in rearwardly facing shoulders 86 which are generally perpendicular to the sidewalls.

Each frame member 53, 55 is cast from zinc in an appropriately configured die. This technique offers great advantages over the prior art since nearly all machining and welding operations are dispensed with. The holes, grooves, slits, notches and other surface configurations may be cast directly in the frame, which is made as an integral unit. The costs of welding and machining operations are avoided. The frame has the appearance of a steel plate unit, yet there are no weld marks. The integral construction renders the frame inherently strong. Frame members 53, 55 are adapted to be assembled together by plates 71. The spacing of the shelves and of the side walls is dependent on the size and number of the compartments.

Figure 5:
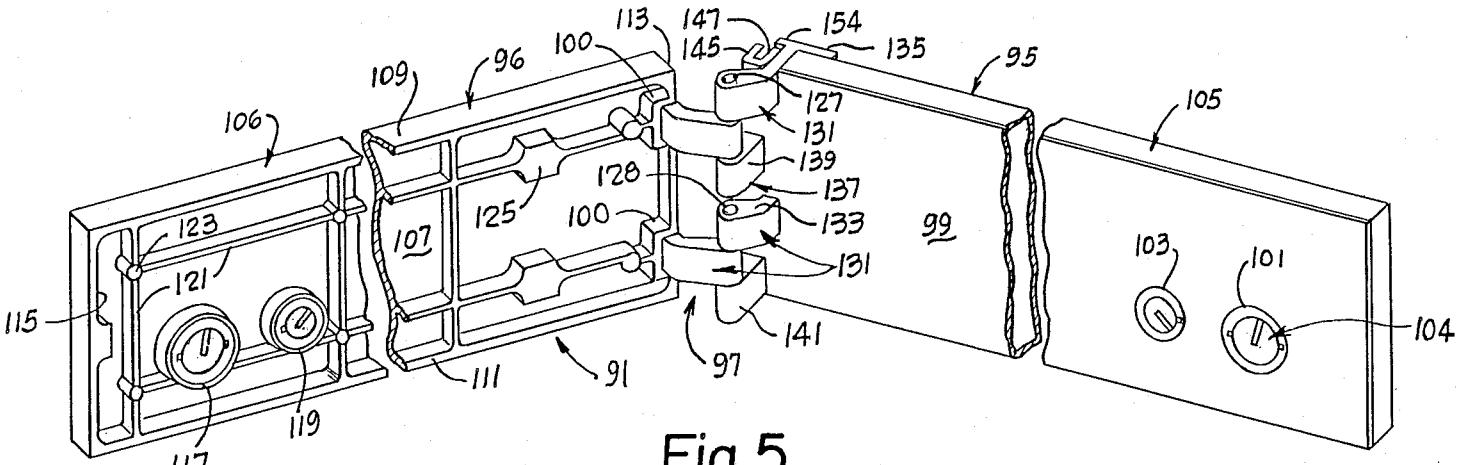
FIG. 5 is a perspective, partially cut away front view of a door assembly of the system of FIG. 1, with the face plate removed from one of the doors of the assembly.
Figure 6:
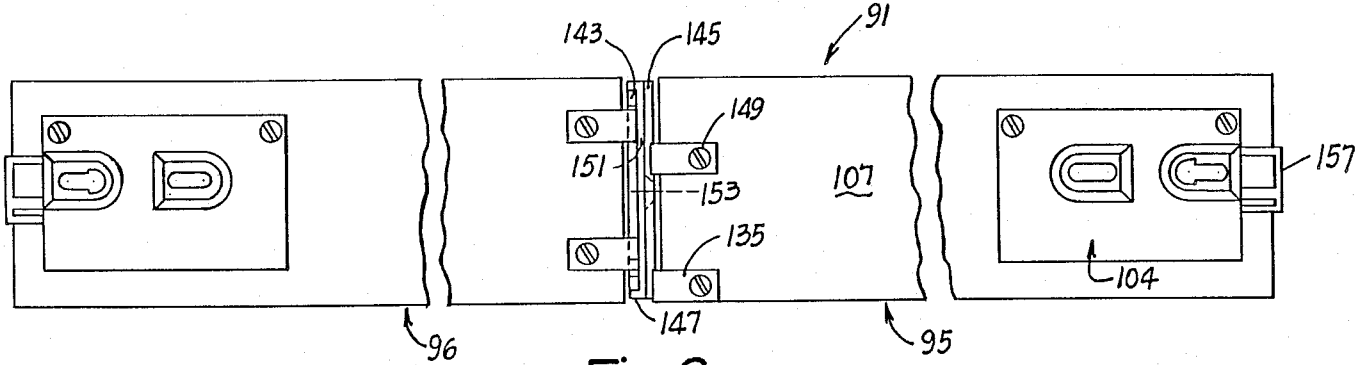
FIG. 6 is the rear view of the door assembly of FIG. 5.

Each compartment is provided with a safety deposit box door. Such doors can be double door assemblies 91 as shown in FIGS. 5 and 6 for closing a pair of adjacent compartments, or single door assemblies. Door assembly 91 includes a pair of nearly identical doors 95 and 96 jointed by a common hinge assembly 97 in a butterfly arrangement. Doors 95, 96 have many identical components, and those are given like identifying numbers herein. Each door 95, 96 has a forwardly facing face plate 99 having openings through which lock key barrels 101 and 103 of a lock assembly 104 are accessible for receiving keys to unlatch the locks for opening the doors. Doors 95, 96 have door bodies 105 and 106 respectively, in which lock key barrels 101 and 103 are mounted. Door bodies 105 and 106 are preferably zinc castings, and each includes a back plate 107, a top wall 109, a bottom wall 111, and opposing side walls 113 and 115. A pair of lock receptacles 117, 119 receive lock key barrels 101 and 103. A set of ribs 121 provide strength and rigidity to the doors, and they further solidify the support for face plate 99. A pair of hinge leaf slots 100 are provided in door body 106 for receiving hinge leaves as discussed below and similar receptacles spaced closer to the upper and lower edges of door 95 are provided in the latter door. A set of generally cylindrical nodes 123 and irregular nodes 125 are provided at various locations for further strengthening the door and lending support to face plate 99. The forwardly facing surfaces of walls 109, 111, 113, 115, receptacles 117 and 119, ribs 121, and nodes 123 and 125 are all ground to be coplanar after the door body is cast, for receiving the back face of face plate 99 as discussed below. After the grinding operation, lock key barrels 101 and 103 are assembled in receptacles 117 and 119.

It is important that doors 95, 96 have a neat and rugged appearance both for aesthetic reasons and for security reasons, since a rugged appearance would discourage would-be burglars. Accordingly, face plate 99 is preferably made of stainless steel sheet stock or aluminum which has been polished, brushed, or anodized and/or colored in some other way. The face plate so finished gives the door the appearance of a solid metal plate construction to achieve the desired end. In order to achieve the appearance of a solid plate door, it is important that the face plate be firmly secured to the door body without any visible attaching means. A particular process for attaching the face plate to the door body has been found to be very effective and economical. Accordingly, it has been found that an epoxy adhesive such as Type 2214 Regular, One Part Heat Cure Epoxy, marketed by The 3M Company may be advantageously used. The adhesive is wiped on the back of the face plate through a stencil having openings corresponding to the locations of the walls, rib nodes and receptacles of the door body. The face plate is then accurately positioned on these coplanar surfaces so that the peripheral edges of the face plate are aligned with the respective outer surfaces of the top, bottom and side walls of the door body, and the door assembly is placed in an oven and the adhesive is cured at 350° F. for 2 minutes or at 325° F. for 4 minutes. The hinge assembly includes a pair of coaxial hinge pins 127, 128 which extend through identical leaves 131 screwed to the rear face of doors 95, 96. Each leaf 131 has a pin socket 133 and a rearwardly extending L-shaped flange 135 which extends through slot 100 in the door body and is screwed to the rear face of the door body by a self tapping screw 149 through holes in flanges 135. A second hinge leaf 137 includes a pair of pin sockets 139, 141 and a rearwardly extending portion having parallel vertical flanges 143, 145 defining a slot 147 for attaching the door assembly 91 to cabinet 3 as described in further detail below. Pin sockets 133 of hinge leaves 131 have bores through which hinge pins 127 and 128 respectively extend for pivotally mounting doors 95 and 96 thereon, and pin sockets 139 and 141 have blind bores closed at their lower ends for receiving the respective hinge pins. Pins 127 and 128 are pressed into sockets 139 and 141, respectively, to secure a tight fit and to prevent them from being removed. The blind bores of the sockets prevent pins 127, 128 from being driven out with a punch or from falling through the bores.

Referring to FIG. 6, the rear face of door assembly 91 is shown. The rear face of each door 95, 96 is the rearwardly facing surface of cast zinc door body 107, and hinge flanges 135 are attached thereto by self-tapping screws 149. Flange 135 includes a locking finger 154 designed to fit behind flanges 143 and 145 of hinge leaf 137 when the door is closed to preclude the prying open of the closed doors in an outward direction. Flange 143 has a pair of screw holes 151 and flange 145 has a screw hole 153, all shown in dotted lines, for receiving screws to attach door assembly 91 to cabinet 3. The lock assembly 104 protrudes through each body 107. Lock bolts 157 are extendable from each lock housing for latching the doors shut as described below.

The construction of door assemblies 95 and 96 has numerous important advantages over known safety deposit doors. These doors are extremely economical as compared to prior safety deposit doors. The die cast door bodies can be fabricated quickly and inexpensively to yield a product which is in its final form save the grinding of the front surfaces. The polishing and brushing steps associated with the construction and maintenance of steel and aluminum doors can be dispensed with or largely reduced. Dies for the zinc castings can be of virtually any size, and the ribbing and wall structure can take on a great variety of configurations. Zinc itself is far less expensive than steel or aluminum. The gluing process for attaching the front face to the door body is fast and inexpensive. Face plates can be stamped quickly and easily from thin rolls or sheets of thin metal, and custom orders can easily be filled. The entire door production process is much faster than the process for constructing solid plate and other prior safety deposit doors, and it lends itself to high speed automatic production techniques. The finished product has the appearance of a solid plate product.

Figure 9:
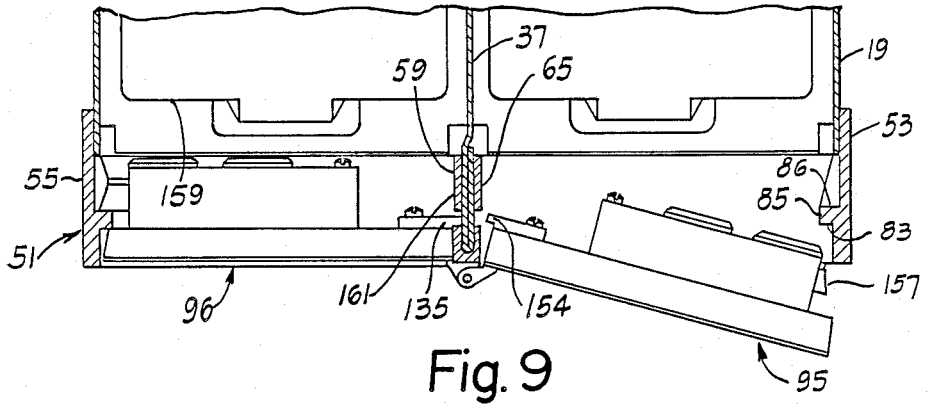
FIG. 9 is a cross-sectional view taken in the direction 9—9 in FIG. 7.
Figure 7:
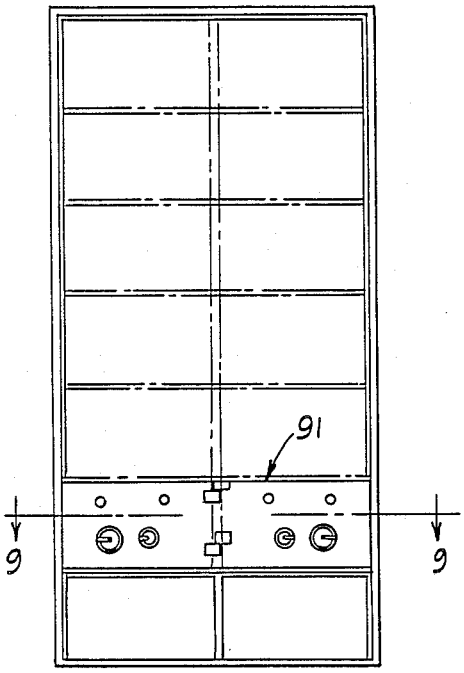
FIGS. 7 and 8 are front and side views of a safety deposit box system like that of FIG. 1, only having two columns of boxes.
Figure 8:
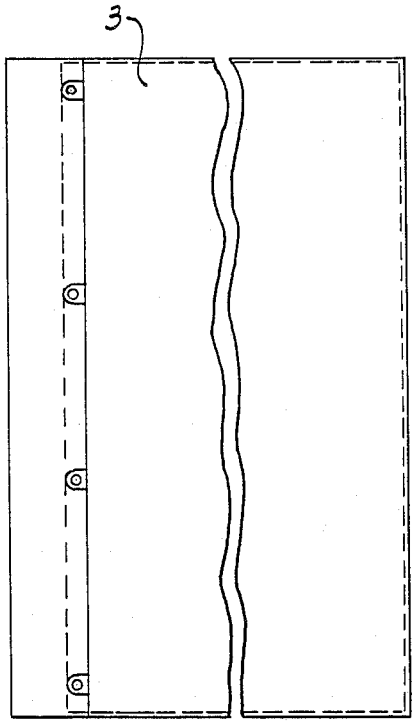

Referring next to FIGS. 7–9, the manner of the assembly of cabinet 3, door frame 51 and door assemblies 91 is shown. Frame 51 is attached directly to cabinet 3. Side walls 53, 55 extend over side walls 19 of cabinet 3, and partition 37 of cabinet 3 extends into slot 75 between frame walls 59 and 65. It should be noted that the forward portion 161 of partition 37 is folded over itself to double the thickness and strength of the partition where it engages frame 5. During the assembly operation, slots 75 cooperate with corresponding structure in cabinet 3 for guiding frame 51 in place and for locating it precisely. Once frame assembly 51 is in position on the cabinet, rivets are inserted through holes 79 in the frame assembly and into corresponding holes in cabinet 3. It is noteworthy that it is virtually impossible for the frame assembly to be installed on the cabinet without inserting the fasteners as in the prior art discussed earlier, because the absence of such fasteners would be readily apparent.

After frame assembly 51 has been attached to cabinet 3, safety deposit box door assemblies 91 are installed. To accomplish this, slot 147 of hinge leaf 137 is inserted on portion 161 of cabinet partition 37 so that the respective doors are positioned to close the adjacent safety box compartments. Screws are inserted through holes 151 and 153 to attach door assembly 91 directly to cabinet 3. This is an important construction feature, because it eliminates the need of an intermediate member between the door assembly and the cabinet, and one cannot gain access to the compartments by removing the frame since the doors are not attached thereto. Besides, one cannot remove the entire door assembly even if one door is open, because all of the screws attaching the door assembly to the cabinet partition are not accessible.

The frame structure positively restricts the inward rotation of the doors. Thus, forward shoulder 83 of vertical ridge 81 limits the closing rotation of the doors, and latch 157 slides behind ridge 81 and engages shoulder 86 as the rear face of the door abuts shoulder 83. When the respective doors are closed, hinge flanges 135 rotate in front of frame walls 59 and 65 as shown in FIG. 5 with reference to door 96. By this arrangement, any effort to smash doors 95 or 96 inward would be resisted by the frame itself as well as the inherent strength of the doors. And, as mentioned earlier, the disposition of locking fingers 154 behind flanges 143, 145 of hinge leaf 137 prevents one from opening the doors by prying them outwardly from their closed positions.

In use, there would normally be provided a box or drawer 159 for holding the contents of the respective compartments. This could appropriately be a plastic box which is slid into and out of the compartments. Thus, a bank official would insert a key in one of the lock key barrels and the bank customer would insert his or her key in the other lock key barrel to open the door; the customer would remove the plastic box from the compartment, do his or her business with the contents of the box, and return the plastic box and close the door. The keys would be turned to lock the door and removed from the lock assembly.

The foregoing description was directed to safety deposit box systems composed of a plurality of double compartments, adjacent pairs of compartments being closed by double door or butterfly door assemblies. Other arrangements also fall within the scope of the invention. Thus, casings or cabinets with columns of single compartments, or with odd numbers of columns of compartments (e.g. "triples") can also be practiced according to the invention. In these arrangements, single door assemblies could be used alone or in conjunction with double door assemblies.

The safety deposit door system described herein the system, and its component doors, frame and cabinet provides great security against break-ins in general, and particularly against undetected break-ins. The construction of preferred embodiment gives the system the appearance of a steel plate system which serves as a deterrent to attempted break-ins. The die cast frame construction renders this aspect of the system economical, and the die cast door bodies and efficient attachment of the face plate thereto add to the economy of the system while retaining its effectiveness. The invention in its preferred form does not require the polishing needed with steel plate units, rendering the present system economical to maintain. The preferred system is of modular construction, so that it can conveniently be assembled at a factory or in the field.

The invention has been described in detail with particular emphasis on the preferred embodiment, but it should be understood that variations and modifications within the spirit and scope of the invention may occur to those skilled in the art to which the invention pertains.

We claim:

1. A safety deposit box system comprising:

a casing including a pair of opposing, parallel vertical casing walls, and a plurality of horizontal casing shelves disposed between said vertical casing walls for cooperating with said vertical walls to define a plurality of compartments, said casing and said vertical walls and said shelves having forward portions;

a frame attached to the forward portion of said casing, said frame including vertical frame walls generally forwardly opposed to said vertical casing walls but rendering one of the vertical casing walls adjacent the respective compartments accessible; and at least one door assembly comprising at least one door for closing a compartment, said door having a free end portion and a hinged end portion, a hinge having first hinge leaf means attachable directly to said accessible vertical casing wall and second hinge leaf means attached to the hinged end portion of the door, and attaching means for engaging said first hinge leaf means and attaching said door assembly directly to said accessible vertical casing wall, said door being pivotable on said hinge about the vertical casing wall to selectively open and close the compartment.

2. The invention according to claim 1 wherein said frame and said vertical frame walls having rearwardly facing vertical slits for receiving the forward portions of said vertical casing walls to position said frame on said casing.

3. The invention according to claim 1 wherein said frame includes a plurality of horizontal frame shelves generally forwardly disposed of the respective casing shelves.

4. The invention according to claim 3 wherein said frame shelves have rearward portions and horizontal slits in said rearward portions for receiving the forward portions of said casing shelves to position said frame on said casing.

5. The invention according to claim 1 wherein said vertical casing walls include a pair of side walls and a vertical casing partition disposed between said side walls, and said casing shelves include shelves extending between said partition and the respective side walls; and said frame includes a pair of frame members each having inner vertical frame walls and outer vertical frame walls, said inner vertical frame walls being opposed and spaced from each other to define a partition opening, and the forward portion of said vertical casing partition extending into said partition opening; said first hinge leaf means being attached to said forward portion of said vertical partition.

6. The invention according to claim 5 wherein said door assembly comprises a pair of doors connected at their hinged end portions to said second hinge leaf means and being pivotable about said frame partition to selectively open and close the compartments on opposite sides of said frame partition.

7. The invention according to claim 1 wherein said frame comprises a die cast frame member.

8. The invention according to claim 1 wherein said door assembly include a door lock mechanism, said mechanism having a latch extendable outwardly from the free end portion of said door, and wherein said vertical frame wall includes a latch receptacle opposite said accessible vertical frame wall for receiving the extended latch and blocking said latch to prevent movement of said door from the closed to the open position.

9. The invention according to claim 1 wherein said door has an inner peripheral portion and said frame has forwardly facing abutment surfaces disposed in the path of said inner peripheral portion when said door is moved from the open to the closed position for impeding the inward rotation of said door from the closed position.

10. The invention according to claim 1 wherein said door has an inner edge at said hinged end portion, and said first hinge leaf means attached to said vertical casing wall is in the path of said inner edge when said door is moved from the open to the closed position for impeding the inner rotation of said door from said closed position.

11. The invention according to claim 1 wherein said second hinge leaf means includes a locking finger, said locking finger being disposed behind said first hinge portion when said door is in the closed position to impede the prying open of the door from the closed position.

12. The invention according to claim 1 wherein said door comprises a die cast, generally hollow door having a first door part including a back wall, opposing pairs of parallel top and bottom walls and of side walls extending forwardly from said backwall and terminating in generally coplanar parallel attachment surfaces, a flat cover in engagement with said attachment surfaces, and attachment means for attaching said cover to said first door part.

13. The invention according to claim 12 wherein said attachment means comprises an adhesive applied to said attachment surfaces.

14. The invention according to claim 12 wherein said first door part further includes support ribs located within the four walls of said first door part and extending forwardly from said back wall and terminating in attachment surfaces coplanar with the attachment surfaces of said four walls.

15. The invention according to claim 1 wherein said first hinge leaf means comprises a mounting member extending rearwardly from the forward surface of said accessible vertical casing wall, and said second hinge leaf means comprises locking finger means diposed rearwardly adjacent said mounting member impeding access to said hinge by a prying instrument to impede the prying open of said door.

* * * * *